United States Patent [19]

Magers

[11] 4,375,266

[45] Mar. 1, 1983

[54] DOWN-LOCKING DISPENSING PUMP WITH SIDE-ORIFICED, PRODUCT-MIXING BALL HOLD-DOWN

[75] Inventor: Wallace F. Magers, Leawood, Kans.

[73] Assignee: Realex Corporation, Kansas City, Mo.

[21] Appl. No.: 207,893

[22] Filed: Nov. 18, 1980

[51] Int. Cl.[3] ..... B67D 5/42

[52] U.S. Cl. ..... 222/321; 222/384

[58] Field of Search ..... 222/320–321, 222/384, 153; 239/333

[56] References Cited

U.S. PATENT DOCUMENTS

| | | | |
|---|---|---|---|
| 2,884,164 | 4/1959 | Kleid | 222/207 |
| 2,956,509 | 10/1960 | Cooprider et al. | 222/384 X |
| 3,185,355 | 5/1965 | Lipman | 222/384 X |
| 3,248,021 | 4/1966 | Corsette et al. | 222/321 |
| 3,967,762 | 7/1976 | Machon | 222/321 |

*Primary Examiner*—Charles A. Marmor

*Attorney, Agent, or Firm*—Schmidt, Johnson, Hovey & Williams

[57] ABSTRACT

The plunger of the pump has a hollow, depending projection at its lower end which engages the ball valve when the plunger is locked down in a fully depressed position for shipment, the projection thereby holding the ball firmly seated against the inlet to the interior of the body so as to prevent leakage should the container be laid on its side or inverted during shipment. During the down stroke of the plunger for normal operation, the product enters the tubular plunger through orifices in the ball hold-down projection, and such orifices are located on the side of the projection, separated by slender, axially extending legs so that as the product enters the projection, it is split into a plurality of turbulent streams by the legs and recombined internally of the projection, thereby imparting a mixing action to the product to aid in keeping the constituents in a homogeneous condition. One form of the projection has a closed tip at its lower end so that all product enters the plunger via the side orifices, while a second form has an opening across the tip to permit a portion of the product to enter at that location. The legs separating the side orifices are yieldably resilient so as to bow outwardly to a certain extent when the plunger is locked down against the ball valve, thereby accommodating dimensional variations that may occur in the length of the plunger and its related components during manufacturing.

4 Claims, 5 Drawing Figures

DOWN-LOCKING DISPENSING PUMP WITH SIDE-ORIFICED, PRODUCT-MIXING BALL HOLD-DOWN

TECHNICAL FIELD

This invention relates to the field of manually-operated dispensing pumps and, more particularly, to those of the so-called "lock-down" variety in which the plungers may be secured in a fully depressed position for shipment or storage.

BACKGROUND ART

In pumps of the down-locking type, it is desirable to maintain the lower check valve of the pump well seated when the plunger is fully locked down in order to keep the inlet to the pumping chamber securely closed during shipment, storage or other handling. Typically, plungers have utilized hold-down components at their lower ends for engaging and retaining the valves closed at these times.

Products to be dispensed by pumps of this type frequently have several constituents, certain of which may tend to settle out and separate from others when the product is left in a static condition for any given length of time. Yet it is important that the product actually dispensed be as nearly homogeneous as possible so that the user receives a dose or portion representing a true fraction of the product as a whole in its homogeneous state, not just a quantity of the liquid carrier or other individual constituent of the product.

SUMMARY OF THE PRESENT INVENTION

Accordingly, one important object of the present invention is to provide a down-locking pump capable of retaining the lower check valve forcefully seated to close its associated inlet when the plunger is locked down, yet which also combines with this feature the ability to induce a beneficial mixing action in the pumping chamber as the plunger is depressed during normal operation to thereby increase the likelihood that the product portion actually dispensed will be in a homogeneous condition reflecting the preferred ratio of constituents one-to-the-other.

In carrying out the foregoing objective, the present invention provides a hollow projection depending from the lower end of the plunger and disposed to engage and forcefully hold down the inlet valve at the lower end of the pump chamber when the plunger is fully locked down. The projection is made inherently yieldably resilient in order to take up dimensional inaccuracies in the length of the plunger and its associated components which may have arisen during manufacturing, and such resiliency is obtained through a series of slender legs formed in the side of the projection which separate a series of elongated orifices serving to admit the product to the interior of the projection and plunger. During lock down, the legs may bow outwardly to a slight extent in order to provide the desired tolerance takeup, and during down stroke of the plunger, the side-located orifices and their separating legs therebetween force the product to split into several turbulent streams in order to enter the interior of the projection and thence the plunger. Such turbulence induces a mixing action within the body of product below the pumping piston of the plunger whereby to promote the discharge of homogeneous portions of the product during each pumping stroke.

DETAILED DESCRIPTION

Figure 1:
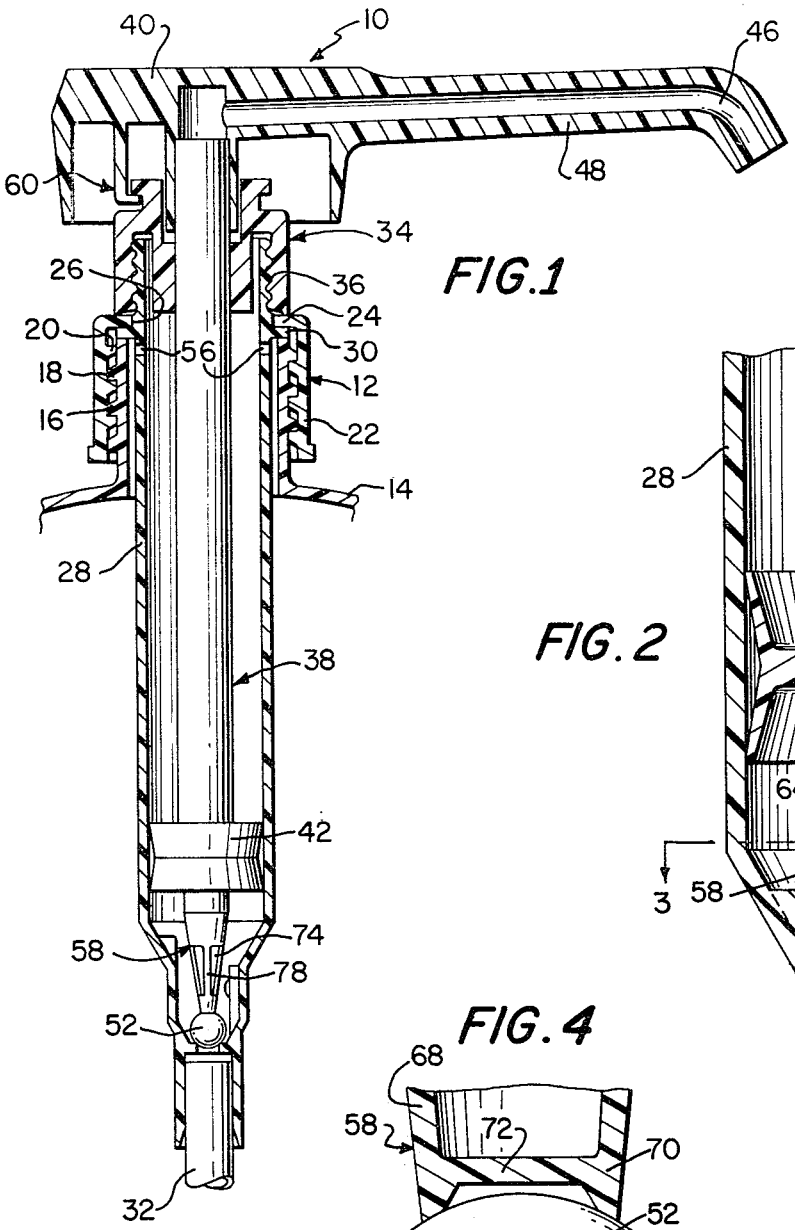
FIG. 1 is a fragmentary, vertical cross-sectional view of a pump constructed in accordance with the principles of the present invention and shown attached to a product container.
Figure 2:
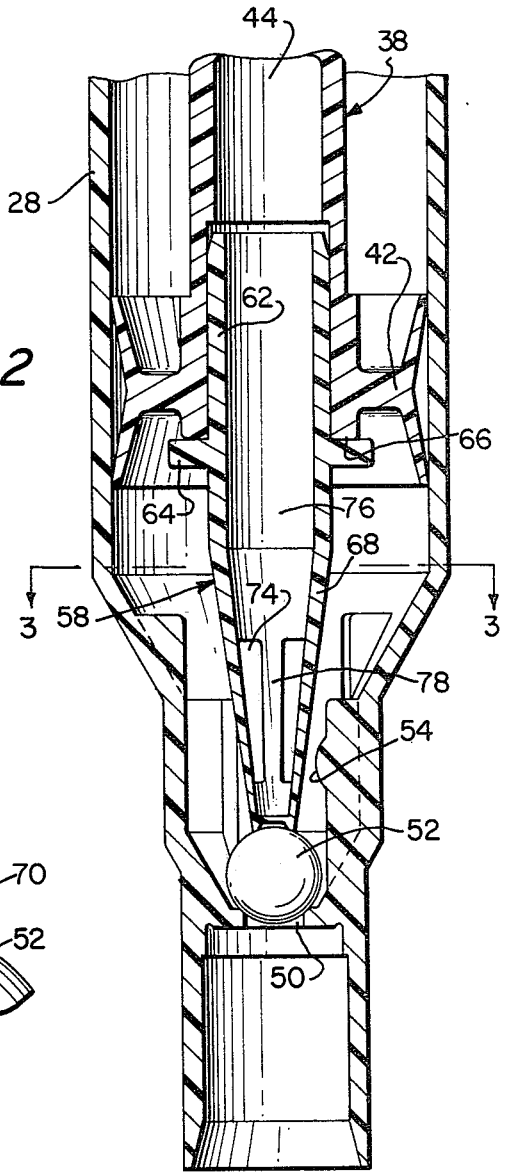
FIG. 2 is an enlarged, vertical cross-sectional view of the lower end of the pump.
Figure 4:
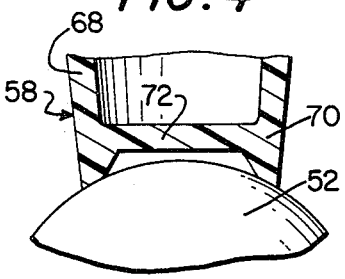
FIG. 4 is a further enlarged, fragmentary, detail view of the tip of the plunger illustrating its engagement with the ball check valve.
Figure 3:
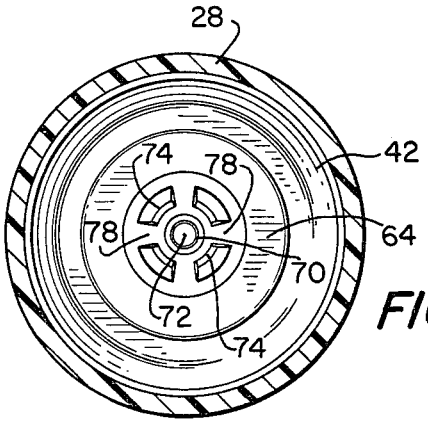
FIG. 3 is a transverse cross-sectional view thereof taken substantially along line 3—3 of FIG. 2.

The pump 10 is installed upon the closure 12 of a container 14 having a neck finish 16 in the nature of external threads 18 which mate with internal threads 20 of the closure 12 formed on the annular sidewall 22 thereof. The top wall 24 of the closure 12 is provided with a centrally disposed opening 26 through which the tubular body 28 of the pump 10 projects. An external, annular flange 30 on the body 28 rests upon the top edge of the neck finish 16 in order to suspend the lower portion of the body 28 and the dip tube 32 down into the interior of the container 14.

In addition to the body 28, the pump 10 further includes an annular collar 34 snapped onto the upper end of the body 28 via interfitting beads and grooves denoted broadly by the numeral 36. The collar 34 serves to attach the pump 10 to the closure 12 such that the closure 12 and the pump 10 together form an assembly which can be threaded onto and off of the container 14 as desired.

The collar 34 is located in axial registration with the body 28 and functions further to provide a bearing surface for the reciprocable plunger 38 of the pump 10 having an operating head 40 at its upper end which may be manually depressed and raised in order to reciprocate the plunger 38 and operate the pump 10. A piston seal 42 adjacent the lower end of the plunger 38 makes sealing contact with the interior surface of the body 28 for the purpose of drawing products into the body 28 below piston seal 42 during an upstroke of the plunger 38, and for pumping such products out of the chamber 28 via a passage 44 in the plunger 38 during a down stroke of the latter. From the passage 44, the products flow to an outlet 46 in the spout 48 of the head 40.

The pump 10 further includes an inlet 50 at the lower end of the body 28 communicating the dip tube 32 with the interior of the body 28. Inlet 50 is controlled by a ball check valve 52 which seats against the inlet 50 to close the latter during a down stroke of the plunger 38 and which rises off the inlet 50 to open the latter during an upstroke of the plunger 38. Upward movement of the ball valve 52 is limited by a series of inwardly projecting shoulders 54 on the body 28 a short distance above the ball 52. A second valve (not shown) is typically located within the plunger 38 adjacent the head 40 for the purpose of closing the passage 44 during upstroke of the plunger 38 and opening the passage 44 during down stroke of the plunger 38. Vent holes 56 in the body 28 slightly below the flange 30 allow the ingress of ambient air into the container 14 from along the interface of the plunger 38 and the collar 34 for the purpose of equalizing pressure externally and internally of the container 14 during the upstroke of the plunger 38.

The plunger 38 is provided with a hollow projection 58 depending from the lower end thereof for the purpose of holding down the ball check valve 52 at such time as the plunger 38 is in a fully depressed position as illustrated in FIG. 1 and locking means 60 of any suitable kind between the head 40 and the collar 34 is engaged. The projection 58 has an upper cylindrical portion 62 securely received within the lower open end of the plunger 38 with a flange 64 of the projection 58 abutting the proximal lower edge 66 of the piston seal 42. The cylindrical portion 62 continues downwardly beyond the flange 64, whereupon a conical portion 68 begins and then terminates in a lowermost tip 70. In the preferred form of the invention, the tip 70 has a web 72 across the same so as to close the lower end of the projection 58 against the entry of products into the latter at that location. A series of elongated orifices 74 are spaced perimetrically about the side of the conical portion 68 for admitting products into the interior passage 76 of projection 58 which in turn communicates with the passage 44 of the plunger 38. The orifices 74 are elongated in the axial direction of the projection 58 and are separated by slender legs 78 located between adjacent ones of the orifices 74. The legs 78 are so constructed as to be yieldably resilient under the application of compressive forces such as occurring during lock down of the plunger 38 and engagement of the tip 70 with the ball valve 52. In this regard, preferably the projection 58, as well as the majority of other components of the pump 10, are constructed from a suitable plastic material such as a polyolefin. Polypropylene has been found to be quite effective.

Figure 5:
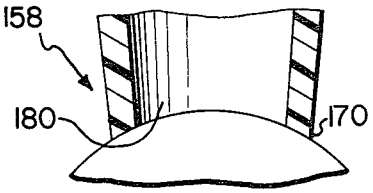
FIG. 5 is a view similar to FIG. 4 of a second form of the invention.

FIG. 5 shows a second form of the invention in which the projection 158 has a tip 170 provided with an opening 180 across the tip 170, said opening 180 thereby providing an additional path for products to enter the projection 158 over and above the side-located orifices in the projection 158 such as the orifices 74 with respect to the projection 58.

OPERATION

The operation and use of the pump 10 should be readily apparent from the foregoing description. Suffice it to point out, then, that as the plunger 38 is reciprocated during operation, product is alternately drawn into the body 28 below the piston seal 42 and then forced out of that area through the passages 76 and 44 to discharge through the nozzle 48. Not infrequently, the pump 10 and its container 14 might be stored during periods of non-use with the plunger 38 fully raised. This means that a full charge of product will have been drawn into the body 28 below the piston seal 42 but not discharged. During the period of non-use, the constituents may tend to settle out or otherwise separate. However, as the plunger 38 is thereafter depressed to discharge the accumulated product, the product is forced to split momentarily into a number of turbulent streams in order to enter the passage 76 of the projection 58 via the orifices 74. Although the streams recombine upon entering the passage 76, the division and separation thereof as they move past the legs 78 through the orifices 74 creates a turbulence that induces a mixing action within the product around and below the projection 58. Consequently, constituents which have previously separated out tend to become remixed into a more homogeneous state, to the end that the portion dispensed will be more truly representative of the nature of the product throughout the entire stroke than might otherwise be the case.

The plunger 38 may be locked down in the position of FIG. 1 at any time, either during initial assembly and filling of the container 14 or later during periods of non-use. In either case, when the plunger 38 is moved to its fully depressed position, the tip 70 of the projection 58 forcefully engages the ball 52 and holds it seated against the inlet 50 to close the latter. Thus, in the event that the container 14 is laid on its side or inverted, the inlet 50 will remain closed to help prevent product from escaping through the plunger 38 and out the spout 48.

The yieldable nature of the slender legs 78 is significant at this time in that it provides a calibrated loading on the ball 52. Moreover, it helps accommodate load variations to suit product viscosity gradients and, perhaps most importantly, allows for variables in linear tolerances which arise during manufacturing and tend to make the plunger 38 and its projection 58 slightly longer or shorter relative to the available length of the body 28.

Both embodiments of FIGS. 1–4 and 5 are effective insofar as both mixing and ball hold down is concerned. The embodiment of FIGS. 1–4 is, however, preferred at least in part because it forces all of the product to pass through the orifices 74 and around the legs 78 in contrast to the embodiment of FIG. 5 wherein a large portion of the product can pass directly up into the opening 180 as the plunger 38 is depressed.

I claim:

1. In a dispensing pump, the improvement comprising:

a tubular body having a collar at one end thereof and an inlet at the opposite end thereof;

a tubular plunger projecting through said collar and reciprocable within said body between depressed and extended positions;

a check valve operably associated with said inlet for opening and closing the same, said valve opening the inlet during movement of the plunger toward said extended position for drawing products into the body through said inlet and closing the inlet during movement of the plunger toward said depressed position for forcing products out of the body through said plunger;

locking means associated with said collar for selectively, releasably locking the plunger in said fully depressed position;

an elongated, hollow, axially located projection on said plunger having a tip disposed for engaging said valve and holding the same in its position closing said inlet when the plunger is locked by said locking means in said fully depressed position; and orifice means in said projection communicating the interior of said body with the interior of said plunger for the discharge of products therethrough during the movement of the plunger toward said depressed position, said orifice means including a plurality of discrete, perimetrically spaced apart orifices located on the side of said projection whereby, as the product enters said projection during discharge, it is mixed by splitting into a plurality of turbulent streams passing through said orifices that recombine internally of the projection into a more homogeneous condition, said orifices being elongated in the axial direction of the projection and cooperating to define a plurality of elongated legs separating adjacent ones of the orifices, each of said legs being yieldably resilient for flexure during holding engagement of the tip with said valve when the plunger is in said fully depressed position.

2. In a pump as claimed in claim 1, wherein said tip has an imperforate web across the same below said orifices to close said projection to the ingress of product except through said orifices.

3. In a pump as claimed in claim 1, wherein said tip has an opening across the same below said orifices permitting the ingress of product.

4. In a pump as claimed in claim 1, wherein said valve includes a ball.

* * * * *